United States Patent [19]

Shields

[11] 4,247,132

[45] Jan. 27, 1981

[54] SKI POLE

[76] Inventor: Michael P. Shields, 5977 Reseda Blvd., Tarzana, Calif. 91356

[21] Appl. No.: 886,931

[22] Filed: Mar. 15, 1978

Related U.S. Application Data

[63] Continuation-in-part of Ser. No. 783,170, Mar. 31, 1977, Pat. No. 4,175,683.

[51] Int. Cl.[3] ..... A45F 3/00; A65D 69/00

[52] U.S. Cl. ..... 280/814; 224/45 S; 280/820; 280/824

[58] Field of Search ..... 224/45 S, 45 R, 49, 224/45 P, 45 Q, 46 R, 52, 55, 58, 250; 280/11.37 K, 11.37 A, 11.37 H, 11.37 B, 11.37 Z, 11.37 E, 821, 814, 822, 816, 819; 211/60 SK

[56] References Cited

U.S. PATENT DOCUMENTS

| | | | |
|---|---|---|---|
| 3,113,786 | 12/1963 | Phillipson | 280/11.37 H |
| 3,737,956 | 6/1973 | Gragert | 280/11.37 A W |
| 4,010,961 | 3/1977 | Goode | 280/11.37 A |

FOREIGN PATENT DOCUMENTS

| | | | |
|---|---|---|---|
| 241319 | 7/1965 | Austria | 280/11.37 Z |
| 261459 | 4/1968 | Austria | 280/11.37 Z |
| 842085 | 5/1970 | Canada | 280/11.37 B |
| 2101611 | 7/1971 | Fed. Rep. of Germany | 280/11.37 Z |
| 2611072 | 7/1977 | Fed. Rep. of Germany | 280/11.37 H |
| 502829 | 3/1971 | Switzerland | 280/11.37 A |

*Primary Examiner*—Robert J. Spar
*Assistant Examiner*—Jerold M. Forsberg
*Attorney, Agent, or Firm*—Lyon & Lyon

[57] ABSTRACT

A ski pole having a basket and grip configuration for use in carrying a pair of skis. The basket defines a first gripping surface for securing the basket to a pair of skis and a second gripping surface for securing the basket to the grip end of a second pole. The grip of each pole is provided with an adjustable rotatably mounted strap for use in holding the basket in gripping contact with the skis. So secured, the skis and two poles are held together to facilitate carrying thereof.

2 Claims, 3 Drawing Figures

FIG. 1.
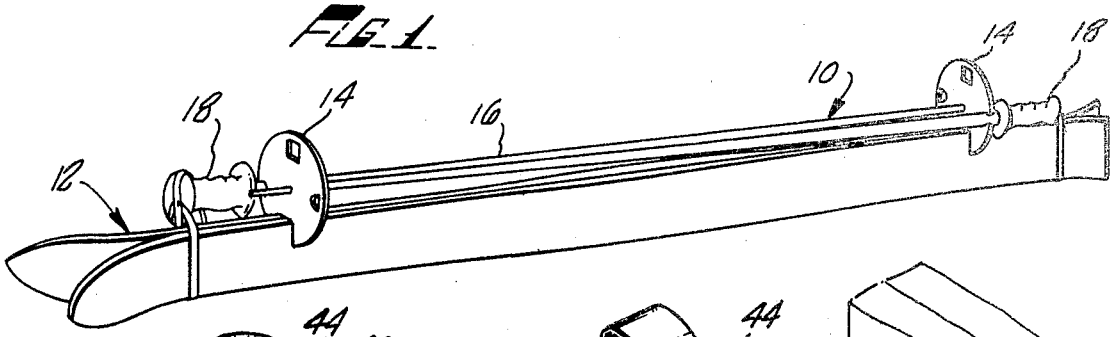
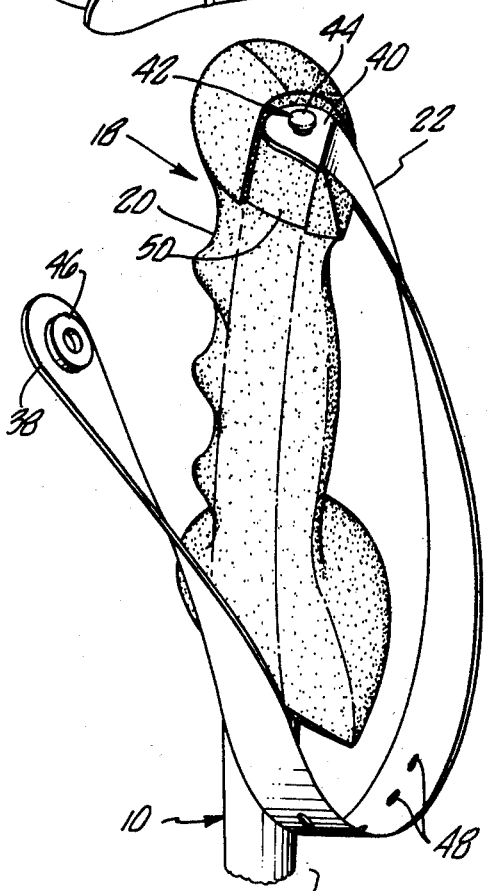
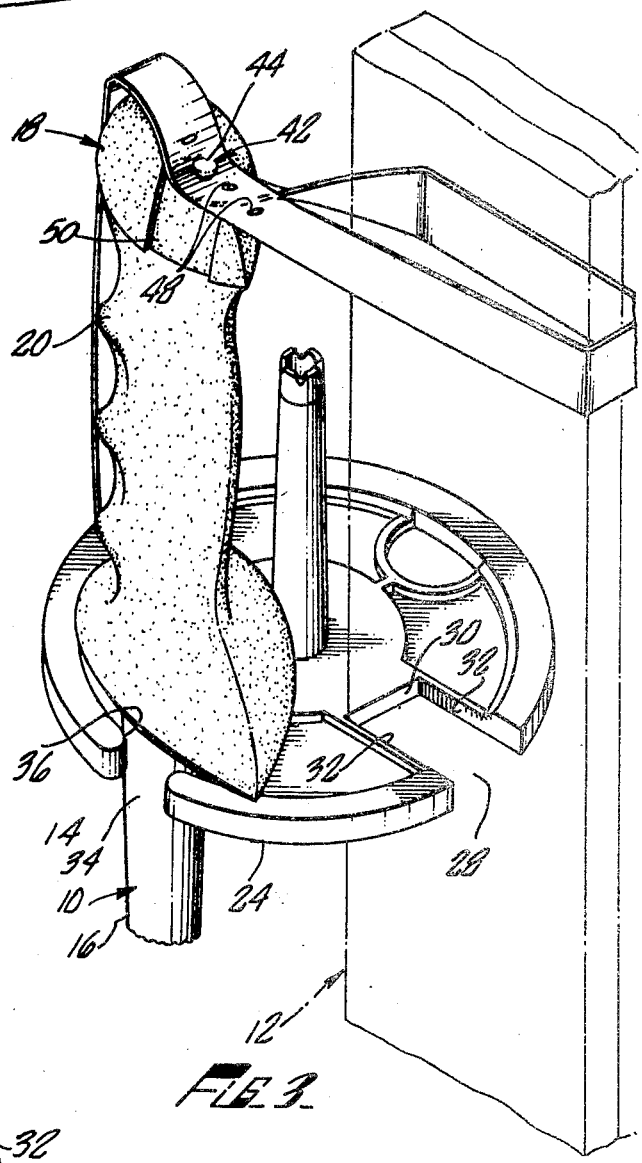
FIG. 3.
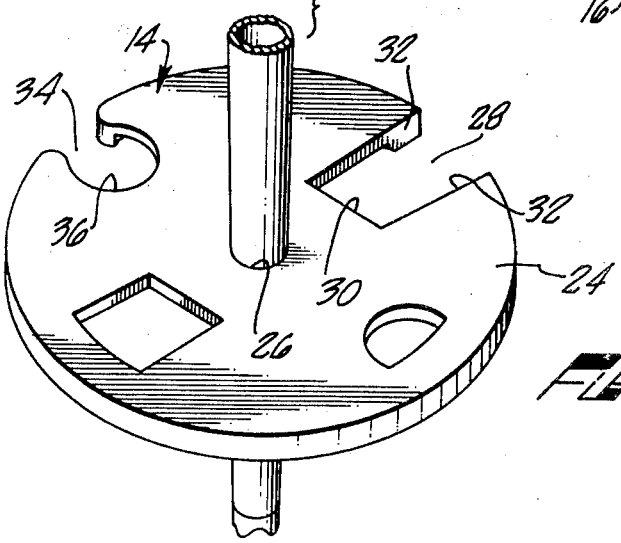
FIG. 2.

SKI POLE

This application is a continuation-in-part of a parent application entitled "Ski Pole Basket Carrying Assembly," Ser. No. 783,170, filed Mar. 31, 1977, now U.S. Pat. No. 4,175,683.

BACKGROUND OF THE INVENTION

The present invention relates to a ski pole, the basket and grip of which when used in combination with a second such pole define a carrying assembly for the snow skier's poles and skis. Snow skis and poles are inherently bulky and unwieldy and accordingly have presented a handling problem when they must be manually carried over any distance. While a few devices have been heretofore developed in an attempt to assist the skier in handling his equipment, such as those described in U.S. Pat. Nos. 3,877,623 and 3,774,826, these devices have met with little acceptance as they have merely substituted one problem for another. The benefit obtained from such devices in facilitating the carrying of one's equipment is offset by the added problem of storing such a device while skiing. As convenient storage facilities are not always readily available and many skiers wish to spend every available minute on the slopes as opposed to searching out such facilities, additional carrying equipment has proved to be quite unpopular. Accordingly, skiers have continued to either secure their skis together with the conventional rubber straps or the like, place the safety straps of the ski poles about the skis in any number of ways in an attempt to reduce the unwieldiness of the equipment. The inevitable result of many such attempts is a comical spectacle involving the knocking and scrapping together of the skis causing damage and dulling to the edges of the skis and often injury to passersby.

SUMMARY OF THE INVENTION

Briefly, the present invention relates to a ski pole having basket and grip portions useful in securing said pole to a second pole of similar construction and to a pair of skis to facilitate carrying of said skis and poles. The basket of the ski pole is adapted to be readily secured both to the other pole adjacent the grip thereof and to transverse portion of the skis. The handle strap of the grip is readily extended about the skis to maintain the skis and poles together for carrying.

It is therefore the principal object of the present invention to provide an approved assembly for facilitating the carrying of snow skis and ski poles.

It is another object of the present invention to provide an assembly for carrying snow skis and ski poles which obviates the need for an additional carrying device.

It is a further object of the present invention to provide a ski pole, the basket and grip portions of which are useful for securing the ski pole both to a second pole and to a pair of skis to facilitate carrying of said poles and skis.

These and other objects and advantages of the present invention will become apparent from the following detailed description taken in conjunction with the accompanying drawings.

DESCRIPTION OF THE PREFERRED EMBODIMENT

In the drawings,

FIG. 1 is a perspective view of a pair of skis and ski poles held together by the ski pole assembly of the present invention.

FIG. 2 is a perspective view of the ski pole of the present invention.

FIG. 3 is an enlarged partial perspective view of the ski pole and basket to bring together a pair of snow skis.

Referring now in detail to the drawings, the ski pole 10 of the present invention is illustrated in FIG. 1 secured to a second pole of the same construction and to a pair of skis 12 to define a compact horizontal carrying assembly wherein the poles act as a handle. The ski pole 10 of the present invention is comprised of a basket 14, shaft 16 and a grip 18.

The ski pole basket 14 is shown most clearly in FIG. 2 and is comprised of a body portion 24 preferably constructed of a resilient plastic material and having a central aperture 26 extending therethrough for receiving the ski pole shaft 16. A first substantially rectangularly shaped recessed area 28 is formed in the body portion 24. This recessed area 28 is defined by a back wall 30 and side walls 32 which are slightly tapered toward each other so that the outer portion of the recessed area 28 is narrower than near the back wall 30. This tapering insures a better grip on the skis. A second recessed area 34 is defined by a curvilinear wall 36. The second recessed area 34 is disposed 90° about the body portion of the basket from the first recessed area 28 and the curvilinear wall 36 defining area 34 extends over center to reduce the transversed dimension of the outer opened end thereof and thereby define a gripping surface for securing the basket 14 to the shaft of a second ski pole as illustrated at FIGS. 1 and 3. The rectangular recessed area 28 is adapted to receive a transversed portion of a pair of skis 12 as is also illustrated in FIGS. 1 and 3. Upon placing the skis within area 28, the resilient nature of the material from which the basket is constructed and the natural camber in the skis causes the side walls 32 to press tightly against the skis thereby securing the basket 14 to the skis 12.

The ski pole grip 18 is best seen in FIG. 3 and includes a handle portion 20 which is affixed to the upper end of the ski pole shaft 16 and a safety strap 22, at least one end 38 of which is detachable from the handle portion of the grip. In the preferred embodiment of the invention illustrated in the drawings, the other end 40 of the strap is secured to the handle such that it is free to swivel about the handle. This mounting can be achieved by a pin 42 having an enlarged head 44 which is carried by the handle and to which end 40 is secured. The detachable end 38 of the strap 22 is provided with a first locking means (aperture) 46 by which that end is secured to the handle for skiing and a plurality of secondary adjustable locking means (spaced apertures) 48 by which the strap can be secured to the handle when disposed about a pair of skis for carrying, as shown in FIGS. 1 and 3. In addition, the grip is provided with an inverted "V"-shaped recessed upper areas 50 which are adapted to receive the strap adjacent to the ends 38 and 40 thereof so that when skiing, the strap and the pin 42 do not extend above the body of the handle.

To secure the ski poles 10 to the skis 12 for carrying as illustrated in FIG. 1, the shafts 16 of the ski poles are inserted into the curvilinear recessed areas 34 in the body portion of the ski pole baskets 14 adjacent the grips 18 thereof thereby locking the ski poles together. In lieu of securing the baskets 14 to the ski pole shaft as described, the baskets could also be secured directly to the handle of the other pole. In such a case, the configuration of the recessed areas might vary according to the ski pole handle configuration in view of the new right and left handed ski poles.

With the ski poles so secured, the skis 12 are inserted into the rectangularly shaped recessed areas 28 in the body portions of the baskets thereby securing the poles to the skis. In view of the weight of the skis, to prevent the skis from falling from the recessed areas 28 while being carried, the detachable end 38 of the safety strap is disengaged from pin 42, the strap is extended about the skis and secured back onto the pin by means of one of the spaced apertures 48 located about midway along the strap. The straps 22 which are preferably constructed of an elastic material thus secure and maintain the skis within the recessed areas of the ski pole baskets to provide a secure and compact assembly for carrying.

In addition to providing an improved assembly for carrying one's skis, the ski pole 10 also has the added safety feature of a releasable safety strap which will disengage from the ski pole handle should the ski pole become entangled with an immovable object such as a tree or the like when skiing thereby precluding any injury which otherwise might occur to the skier's wrist or arm. While in the drawings only one means is illustrated for securing the strap 22 to the ski pole handle 20 such that one end of the strap is detachable and the other is preferably free to swivel about the handle, it is to be understood that different means could be employed for accomplishing such attachment. For example, if the basket were secured to the ski pole shaft by a friction ring or the like such that it was prevented from undergoing any rotational movement with respect to the shaft, it would not be necessary to swivelly mount the end 40 of the safety strap onto the ski pole handle. During construction of the ski pole, the handle could be mounted on the shaft such that the strap would always be properly aligned with respect to the skis when securing the skis to the ski pole basket.

Various other changes and modifications may be made in carrying out the present invention without departing from the spirit and scope thereof. Insofar as these changes and modifications are within the purview of the appended claims, they are to be considered as part of the present invention.

I claim:

1. A ski pole for use in securing together a pair of skis to facilitate carrying thereof, said ski pole comprising a basket, a ski pole shaft and a grip, said basket being carried by said shaft and having a first recessed area therein, said area defining a curvilinear gripping surface and having an outer opening of reduced transverse dimension for receiving a second ski pole therein and a second recessed area radially positioned within said basket and disposed approximately 90° about said basket with respect to said first recessed area for receiving a transverse portion of a pair of adjacently disposed skis, said grip being secured to the upper end of said shaft and including a handle and an expansible safety strap, one end of said strap being swivelly mounted on said handle, a pin member having an enlarged head portion carried by said handle in the upper portion thereof, said strap having apertures adjacent each end thereof and at least one intermediary aperture disposed therebetween such that upon inserting said pin member through said apertures disposed adjacent the ends of said strap, said strap is detachably mounted on said pole in a skiing mode, said handle having an inverted "V"-shaped channel disposed in the upper end thereof adapted to receive portions of said strap adjacent the ends thereof such that in a skiing mode said portions of said strap lie substantially flush with said handle, whereby upon disposing said second pole within said first recessed area of said basket and transverse portions of said skis within said second recessed area of said basket and detaching one end of said strap from said pin member, extending said strap about said pair of adjacently disposed skis and inserting said pin member through one of said intermediary apertures, said skis are secured to said basket and ski pole.

2. A pair of ski poles for use in securing together a pair of skis to facilitate carrying thereof, each of said ski poles comprising a basket, a ski pole shaft and a grip, said basket being carried by said shaft and having a recessed area therein, said area defining a curvilinear gripping surface and having an outer opening of reduced transverse dimension for retaining the other of said ski poles therein and a second recessed area radially positioned within said basket and disposed approximately 90° about said basket with respect to said first recessed area for receiving a transverse portion of a pair of adjacently disposed skis, said grip being secured to the upper end of said shaft and including a handle and expansible safety strap, one end of said strap being swivelly mounted on said handle, said handle having an inverted "V"-shaped channel disposed in the upper end thereof adapted to receive portions of said strap adjacent the ends thereof such that in a skiing mode said portions of said strap lie substantially flush with said handle, a pin member having an enlarged head portion carried by said handle in the upper end thereof, said strap having apertures adjacent each end thereof and at least one intermediary aperture disposed therebetween such that upon inserting said pin member through said apertures disposed adjacent the ends of said strap, said strap is detachably mounted on said pole in a skiing mode, whereby upon disposing each of said ski poles adjacent the handles thereof within the first recessed areas of said baskets and disposing transverse portions of said skis within said second recessed areas of said baskets and upon detaching one end of said straps from said pin members, extending said straps about said pair of adjacently disposed skis and inserting said pin members through one of said intermediary apertures, said skis are secured to said baskets and said ski poles.

* * * * *